US012624471B2

(12) United States Patent
Kikuchi et al.

(10) Patent No.: US 12,624,471 B2
(45) Date of Patent: May 12, 2026

(54) ALUMINUM MEMBER AND MANUFACTURING METHOD THEREOF

(71) Applicants: National University Corporation Hokkaido University, Sapporo (JP); UACJ Corporation, Tokyo (JP)

(72) Inventors: Tatsuya Kikuchi, Sapporo (JP); Miu Sato, Sapporo (JP); Junji Nunomura, Sapporo (JP); Yoshiyuki Oya, Aichi (JP)

(73) Assignees: National University Corporation Hokkaido University, Sapporo (JP); UACJ Corporation, Tokyo (JP)

( * ) Notice: Subject to any disclaimer, the term of this patent is extended or adjusted under 35 U.S.C. 154(b) by 173 days.

(21) Appl. No.: 17/927,998

(22) PCT Filed: Jun. 11, 2021

(86) PCT No.: PCT/JP2021/022288
§ 371 (c)(1),
(2) Date: Nov. 28, 2022

(87) PCT Pub. No.: WO2022/009606
PCT Pub. Date: Jan. 13, 2022

(65) Prior Publication Data

US 2023/0212776 A1 Jul. 6, 2023

(30) Foreign Application Priority Data

Jul. 9, 2020 (JP) ..... 2020-118492

(51) Int. Cl.
*C25D 11/06* (2006.01)
*C25D 11/14* (2006.01)

(52) U.S. Cl.
CPC ..... *C25D 11/06* (2013.01); *C25D 11/14* (2013.01)

(58) Field of Classification Search
None
See application file for complete search history.

(56) References Cited

U.S. PATENT DOCUMENTS 6,096,184 A * 8/2000 Yoshida ..... C25D 11/12 205/175
10,844,506 B2 11/2020 Nunomura
(Continued)

FOREIGN PATENT DOCUMENTS

CN 109837579 A 6/2019 ..... C25D 11/08
JP S58760 B2 1/1983
(Continued)

OTHER PUBLICATIONS

Ono et al. "Porous/Barrier Composite Films Formed on Aluminum by Re-anodizing" 64, No. 9, 1996 (Year: 1996).*
(Continued)

*Primary Examiner* — Stefanie S Wittenberg
(74) *Attorney, Agent, or Firm* — J-TEK LAW PLLC; Jeffrey D. Tekanic; Scott T. Wakeman

(57) ABSTRACT

An aluminum member (1) includes: a base material (2) composed of aluminum or an aluminum alloy; and an anodic oxide film (3) formed on a surface of the base material. The anodic oxide film includes: an amorphous layer (31), which is composed of an amorphous aluminum oxide and is formed on the base material (2); and a crystal layer (32), which is composed of a crystalline aluminum oxide and is formed on the amorphous layer (31). The aluminum member (1) can be obtained by forming the anodic oxide film (3) on the base material (2) by performing an anodization process on the base material (2) in an electrolytic solution, which contains boron atoms and has a pH of 7.0-12.0.

23 Claims, 3 Drawing Sheets

(56) References Cited

U.S. PATENT DOCUMENTS

| | | | | |
|---|---|---|---|---|
| 2010/0282455 | A1 | 11/2010 | Maegawa et al. | F28F 1/24 |
| 2019/0161881 | A1 | 5/2019 | Nunomura | |

FOREIGN PATENT DOCUMENTS

| | | | | |
|---|---|---|---|---|
| JP | H10107027 | A1 | 4/1998 | |
| JP | 2003171794 | A1 | 6/2003 | |
| JP | 2015025184 | A | 2/2015 | C25D 11/04 |
| JP | 2020033591 | A | 3/2020 | |
| WO | 2017216577 | A1 | 12/2017 | |

OTHER PUBLICATIONS

Sato et al. "Effects of Electrolyte Species and Their Combination on Film Structures and Dielectric Properties of Crystalline Anodic Alumina Films Formed by Two- Step Anodization", Materials Transactions, vol. 54, No. 10, 2013, pp. 1993-1999 (Year: 2013).*

Ono et al. Effects of Current Density and Temperature on the Morphology and Electric Property of Anodic Films on Aluminum, Proceedings of Electrochemical Society, 2001, 1129-1136 (Year: 2001).*

Li et al. "Formation and Breakdown of Anodic Oxide Films on Aluminum in Boric Acid/Borate Solutions", JES, 1997, 144, 866 (Year: 1997).*

Shimizu et al. "The electrical breakdown during anodizing of high purity aluminum in borate solutions", Thin Solid Films, 92, 1982, 231-241 (Year: 1982).*

Takahashi et al. "Anodizing of Aluminum Covered with Hydroxide I. Formation of Hydroxide and Composite Oxide Films", Hyomen Gijutsu, vol. 38, No. 2, 1987. (Year: 1987).*

Shimizu et al., "The Development of Flaws Containing γ-Crystalline Alumina Regions in Barrier Anodic Films on Aluminum", Electrochimica Acta, vol. 25, pp. 1481-1486, 1980. (Year: 1980).*

English translation of the International Search Report mailed Aug. 31, 2021 in parent application No. PCT/JP2021/022288.

English translation of the Written Opinion of the International Searching Authority in parent application No. PCT/JP2021/022288.

Office Action from the Japanese Patent Office dispatched Jul. 2, 2024, in related Japanese application No. 2020-118492, and translation thereof.

Office Action from the Chinese Patent Office dispatched Dec. 18, 2024, in counterpart CN application No. 202180047513.6, and translation thereof.

Machine Translation of Ono et al. "Porous/Barrier Composite Films Formed on Aluminum by Re-anodizing" 64, No. 9, 1996 (Year: 1996).

* cited by examiner

ALUMINUM MEMBER AND MANUFACTURING METHOD THEREOF

CROSS-REFERENCE

This application is the US national stage of International Patent Application No. PCT/JP2021/022288 filed on Jun. 21, 2021, which claims priority to Japanese Patent Application No. 2020-118492 filed on Jul. 9, 2020.

TECHNICAL FIELD

The present invention relates to an aluminum member and to a manufacturing method thereof.

BACKGROUND ART

Aluminum members have various applications such as in construction materials, electronic device housings, mechanical parts, and the like. A functional coating is sometimes provided on the surface of an aluminum member for the purpose of imparting characteristics such as design characteristics, corrosion-resistance characteristics, wear-resistance characteristics, insulation characteristics, and the like.

As an example of a functional coating that is provided on a surface of an aluminum member, an anodic oxide film is known. The characteristics of an anodic oxide film vary in accordance with the structure, the fabrication method, and the like of the anodic oxide film. For example, in Patent Document 1, a method of forming an anodized-alumina coating is described, wherein anodization of aluminum is performed by immersing a substrate, which has aluminum exposed on a surface, in a first electrolyte, in which an electrolyte containing boron has been dissolved, and then further performing anodization by immersing the substrate in a second electrolyte, in which an electrolyte that does not contain boron has been dissolved.

In addition, in Patent Document 2, a method of forming a ceramic coating is described, wherein a ceramic coating containing aluminum oxide is formed on the base surface of aluminum or aluminum alloy using anodic-spark discharge in an aqueous electrolytic bath containing: (a) nitrogen-atom-containing cations and (b) amino-carboxylate anions having a stability constant with respect to aluminum of 9 or higher.

PRIOR ART LITERATURE

Patent Documents

Patent Document 1
Japanese Laid-open Patent Publication H10-107027
Patent Document 2
Japanese Laid-open Patent Publication 2003-171794

SUMMARY OF THE INVENTION

According to the method of Patent Document 1, a type of anodic oxide film called a barrier-type, anodic oxide film can be formed. Because the barrier-type, anodic oxide film is relatively dense, it excels in insulation characteristics, corrosion-resistance characteristics, etc. However, because it is difficult to make the barrier-type, anodic oxide film thick, there is a problem in that it is inferior in wear-resistance characteristics, hardness, etc.

In addition, according to the method of Patent Document 2, a type of anodic oxide film called a plasma electrolytic oxide film can be formed. Because the plasma electrolytic oxide film is composed of a crystalline aluminum oxide and can easily be made thick, it excels in wear-resistance characteristics. However, because small holes are easily formed in the plasma electrolytic oxide film, there is a problem in that it is inferior in insulation characteristics.

It is one non-limiting object of the present teachings to provide an aluminum member having an anodic oxide film that excels in one or more of insulation characteristics, corrosion-resistance characteristics, and wear-resistance characteristics, and to provide a manufacturing method thereof.

In one aspect of the present teachings, an aluminum member comprising may comprise:

- a base material composed of aluminum or an aluminum alloy; and
- an anodic oxide film formed on a surface of the base material;
- wherein the anodic oxide film comprises:
  - an amorphous layer, which is composed of an amorphous aluminum oxide and is formed on the base material; and
  - a crystal layer, which is composed of a crystalline aluminum oxide and is formed on the amorphous layer.

Another aspect of the present invention is a method of manufacturing the aluminum member according to the above-mentioned aspect, wherein the anodic oxide film is formed by performing an anodization process on the base material in an electrolytic solution, which contains boron atoms and has a pH of 7.0 or more and 12.0 or less.

The anodic oxide film, which comprises the amorphous layer and the crystal layer, is present on a surface of the aluminum member. Because the amorphous layer is composed of a relatively dense amorphous aluminum oxide, excellent insulation characteristics and corrosion-resistance characteristics can be imparted to the aluminum member. In addition, because the crystal layer is composed of a relatively hard crystalline aluminum oxide, excellent wear-resistance characteristics can be imparted to the aluminum member.

Thus, the anodic oxide film has both excellent insulation characteristics and corrosion-resistance characteristics of the barrier-type, anodic oxide film and excellent wear-resistance characteristics of the plasma electrolytic oxide film. For this reason, the aluminum member has excellent insulation characteristics, corrosion-resistance characteristics, and wear-resistance characteristics.

In addition, in the method of manufacturing the aluminum member, the anodization process is performed on the base material in the specific electrolytic solution. By using the specific electrolytic solution as the electrolytic solution, the amorphous layer can be formed in an initial stage of the anodization process. In addition, when the anodization process progresses and the thickness of the amorphous substance has become thick to a certain extent, dielectric breakdown occurs on the surface of the amorphous layer, and thereby discharges accompanied by light emissions tend to occur. Thereby, the crystal layer can be formed on the amorphous layer.

For this reason, according to the method of manufacturing the aluminum member, the anodic oxide film can be formed on the base material using a simple method.

According to the aspects as described above, an aluminum member having an anodic oxide film that excels in insulation characteristics, corrosion-resistance characteristics, and wear-resistance characteristics, and a manufacturing method thereof can be provided.

DETAILED DESCRIPTION (Aluminum Member)

Figure 1:
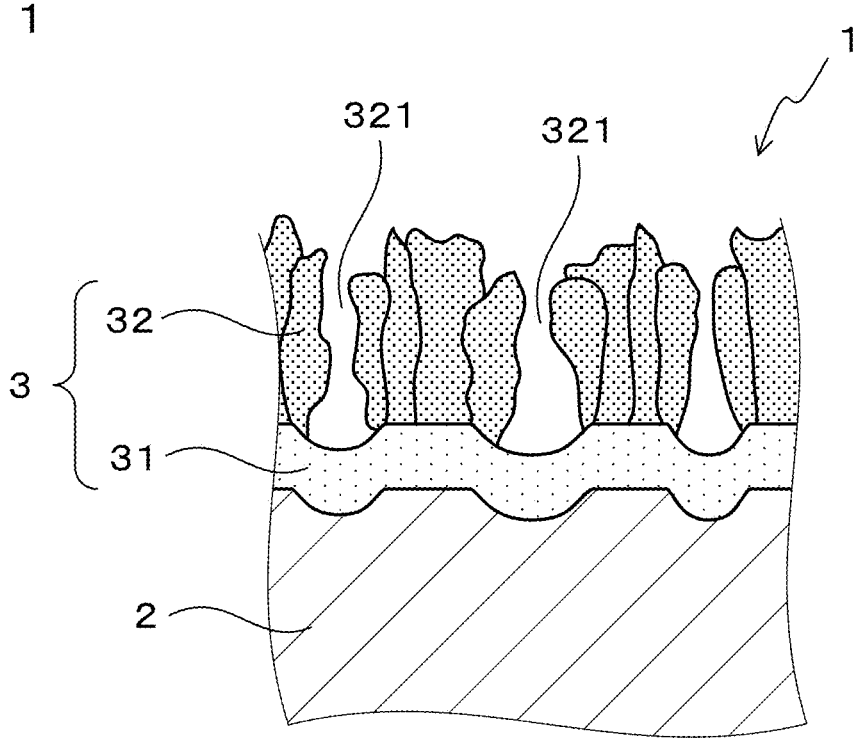
FIG. 1 is a cross-sectional view of an aluminum member according to a working example.
Figure 2:
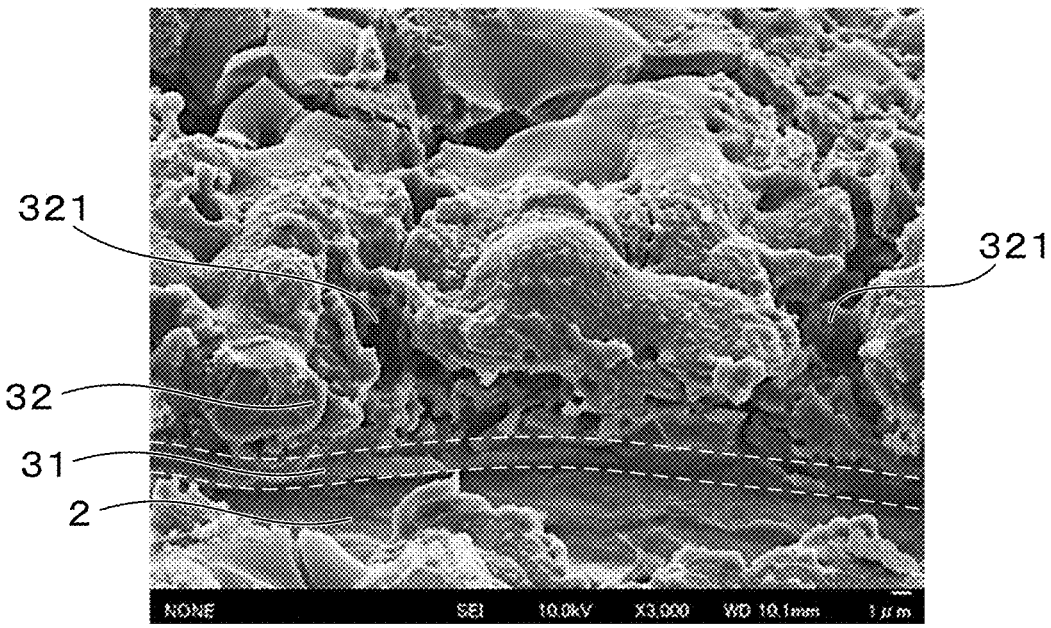
FIG. 2 is an electron micrograph of a fractured surface of an anodic oxide film of Test Material B according to a working example.

The above-mentioned aluminum member comprises a base material and an anodic oxide film, which is formed on a surface of the base material. The shape of the aluminum member is not particularly limited, and the aluminum member can be made into a suitable shape in accordance with the application of the aluminum member. In addition, the anodic oxide film may be provided on the entire surface of the base material or may be provided on a portion or portions of a surface or surfaces of the base material.

The material of the base material of the aluminum member is aluminum or an aluminum alloy but is not particularly limited. For example, high-purity aluminum, JIS A1000-series aluminum, an A2000-series alloy, an A3000-series alloy, an A4000-series alloy, an A5000-series alloy, an A6000-series alloy, an A7000-series alloy, an A8000-series alloy, or the like can be used as the material of the base material.

For example, in the situation in which the material of the base material is a relatively high-strength aluminum alloy, such as an A5000-series alloy or an A6000-series alloy, the strength of the aluminum member can be made high. For that reason, an aluminum member comprising a base material composed of an A5000-series alloy or an A6000-series alloy is ideally suited to applications that require high strength such as, for example, automobile materials, structural materials, or the like.

In addition, in the situation in which, for example, the material of the base material is A1000-series aluminum or an A3000-series alloy, coloring of the anodic oxide film can be inhibited, and thereby the color tone of the aluminum member can be set to a color tone that is close to white. Such an aluminum member itself can be used in applications that require a white external appearance. Furthermore, the closer that the color tone of the aluminum member is to white, the easier it becomes to color the surface of the aluminum member to a desired color. For that reason, an aluminum member comprising a base material composed of A1000-series aluminum or an A3000-series alloy is ideally suited to applications that require design characteristics such as, for example, exterior materials, electronic device housings, and the like.

The anodic oxide film is formed on the base material. The anodic oxide film comprises an amorphous layer, which is formed on the base material, and a crystal layer, which is formed on the amorphous layer.

The amorphous layer is composed of an amorphous aluminum oxide. Because the amorphous layer is relatively dense as was described above, insulation characteristics and corrosion-resistance characteristics can be imparted to the aluminum member. The composition of the aluminum oxide comprising the amorphous layer is determined in accordance with the material of the base material. That is, the amorphous layer is composed principally of aluminum atoms and oxygen atoms. In addition, other than aluminum atoms and oxygen atoms, the amorphous layer can contain the alloying elements contained in the base material.

Whether or not the amorphous layer is formed on the anodic oxide film can be determined based on an X-ray diffraction chart obtained by X-ray crystallography. That is, in the situation in which a broad peak having a vertex in the range of diffraction angles 20°-40° appears in the X-ray diffraction chart, it can be determined that an amorphous layer composed of an amorphous aluminum oxide is formed in the anodic oxide film.

The thickness of the amorphous layer may be, for example, 0.05 μm or more and 1.0 μm or less. In this situation, the number of defects in the amorphous layer can be further reduced, and thereby the effect of improving the insulation characteristics and the corrosion-resistance characteristics of the aluminum member can be more reliably achieved. From the viewpoint of more reliably obtaining such functions and effects, the thickness of the amorphous layer preferably is 0.10 μm or more and 0.90 μm or less, and more preferably is 0.20 μm or more and 0.80 μm or less.

The thickness of the amorphous layer is set to a value calculated by the following method. That is, first, an electron micrograph is acquired by observing a cross section of the above-mentioned aluminum member using a scanning-electron microscope or the like. Ten measurement locations are randomly selected from the amorphous layer in the electron micrograph. Furthermore, the arithmetic-average value of the thicknesses of the amorphous layer at these measurement locations is set as the thickness of the amorphous layer described above.

The crystal layer, which is composed of a crystalline aluminum oxide, is layered on the amorphous layer. Because the crystal layer composed of a crystalline aluminum oxide is relatively hard, as described above, it can impart wear-resistance characteristics to the aluminum member. The crystal layer is composed of a crystalline aluminum oxide such as $\alpha$-$Al_2O_3$ or $\gamma$-$Al_2O_3$. More specifically, the crystal layer may be composed of $\alpha$-$Al_2O_3$ or may be composed of $\gamma$-$Al_2O_3$. In addition, the crystal layer may be composed of $\alpha$-$Al_2O_3$ and $\gamma$-$Al_2O_3$. Furthermore, in addition to these aluminum oxides, the crystal layer can contain the alloying elements contained in the base material.

Whether the crystal layer is formed in the anodic oxide film can be determined based on an X-ray diffraction chart obtained by X-ray crystallography. That is, in the situation in which a diffraction peak that derives from a crystalline aluminum oxide, such as $\alpha$-$Al_2O_3$ and $\gamma$-$Al_2O_3$, appears in the X-ray diffraction chart, it can be determined that a crystal layer is formed in the anodic oxide film.

The thickness of the crystal layer may be, for example, 1.0 μm or more. In this situation, the thickness of the crystal layer can be made sufficiently thick, and thereby the effect of improving the wear-resistance characteristics can be more reliably achieved. From the viewpoint of more reliably obtaining such functions and effects, the thickness of the crystal layer preferably is 2.0 μm or more, and more preferably is 3.0 μm or more.

In addition, the thickness of the crystal layer preferably is 5.0 μm or more and 15.0 μm or less, more preferably is 6.0 μm or more and 14.0 μm or less, and yet more preferably is 7.0 μm or more and 13.0 μm or less. In this situation, the color tone of the aluminum member can be set to a color tone that is close to white. As a result, the design characteristics of the above-mentioned aluminum member can be further improved.

The method of measuring the thickness of the crystal layer is the same as the method of measuring the thickness of the amorphous layer described above. That is, first, an electron micrograph is obtained by observing a cross section of the above-mentioned aluminum member using a scanning-electron microscope or the like. Ten measurement locations are randomly selected from the crystal layer in this electron micrograph. Furthermore, the arithmetic-average value of the thicknesses of the crystal layer at these measurement locations is set as the thickness of the crystal layer described above.

The crystal layer may have a plurality of small holes formed on the surface of the above-mentioned aluminum member. In this situation, external light that impinges the anodic oxide film can be sufficiently scattered at the crystal layer, and thereby the perceptual transparency of the anodic oxide film can be further decreased. Furthermore, by decreasing the perceptual transparency of the anodic oxide film, the color tone of the base material, which is the underlying base, can be effectively hidden. As a result, the color tone of the above-mentioned aluminum member can further approach white, and thereby the design characteristics can be further improved.

From the viewpoint of more reliably achieving such functions and effects, the crystal layer preferably has small holes having an average diameter of 1 μm or more and 20 μm or less.

The average diameter of the small holes existing in the crystal layer is set to a value calculated by the following method. That is, first, an electron micrograph is acquired by observing the surface of the above-mentioned crystal layer using a scanning-electron microscope or the like. Small holes to be measured are randomly selected at 10 locations in this electron micrograph. Next, the maximum width of each small hole to be measured, i.e., the maximum-width value from among the values obtained by measuring the width of each small hole from various directions, is determined. The arithmetic-average value of the maximum widths of the small holes at the 10 locations determined in this manner is set as the average diameter of the small holes.

Arithmetic-average roughness Ra of the surface of the above-mentioned anodic oxide film preferably is 0.5 μm or more and 1.5 μm or less. In this situation, external light that impinges on the anodic oxide film can be sufficiently scattered at that surface, and thereby the perceptual transparency of the anodic oxide film can be further decreased. Furthermore, by decreasing the perceptual transparency of the anodic oxide film, the color tone of the base material, which is the underlying base, can be effectively hidden. As a result, the color tone of the above-mentioned aluminum member can further approach white, and thereby the design characteristics can be further improved. It is noted that arithmetic-average roughness Ra of the surface of the anodic oxide film is a value determined by a method that is compliant with JIS B0601:2013.

The L* value of the CIE 1976 L*a*b* color space, which is obtained by measuring the color tone of the surface of the above-mentioned aluminum member that has the anodic oxide film, preferably is 70.0 or more. The L* value of the CIE 1976 L*a*b* color space is a value from 0 to 100, wherein the larger the value, the greater the brightness of the color.

By setting the L* value of the surface of the aluminum member having the above-mentioned specific configuration to the above-mentioned specific range, the color tone when the surface of the aluminum member is observed can further approach white. As described above, an aluminum member in which the color tone of the surface approaches white can be suitably used in applications that require a white external appearance.

In addition, in the situation in which the surface of the white aluminum member has been colored with a chromatic color by, for example, a coating or the like, the color tone after the coloring tends not to be affected by the color tone of the base material, and thereby the desired chromatic color can be more easily implemented.

Thus, because an aluminum member having an L* value in the above-mentioned specific range can easily achieve a desired color tone, it excels in design characteristics. From the viewpoint of further enhancing the design characteristics of the aluminum member, the L* value of the CIE 1976 L*a*b* color space preferably is 75 or more and more preferably is 80 or more. It is noted that, from the viewpoint of further enhancing the design characteristics of the aluminum member, it is preferable that the L* value is as close as possible to 100, which is the upper limit.

(Method of Manufacturing Aluminum Member)

The method of manufacturing the above-mentioned aluminum member includes a process in which an anodization process is performed on the base material in an electrolytic solution that contains boron atoms and has a pH of 7.0 or more and 12.0 or less. When the anodization process is performed on the base material, which is composed of aluminum or an aluminum alloy, using the above-mentioned specific electrolytic solution, an amorphous layer composed of an amorphous aluminum oxide is formed on the surface of the base material in an initial stage of the anodization process.

As the anodization process progresses, the thickness of the amorphous layer increases and, attendant therewith, the electrical-insulating properties of the amorphous layer improve. Furthermore, when the electrical-insulating properties of the amorphous layer improve and thereby an anode reaction no longer readily occurs on the surface of the base material, minute and irregular discharges called micro arcs occur discontinuously on the surface of the amorphous layer. By the repetitive melting and solidifying of the surface of the amorphous layer owing to these micro arcs, a crystal layer is formed on the surface of the amorphous layer.

As described above, by performing the anodization process using the above-mentioned specific electrolytic solution, the anodic oxide film comprising the amorphous layer, which is layered on the base material, and the crystal layer, which is layered on the amorphous layer, can be formed easily.

In the method of manufacturing the above-mentioned aluminum member, prior to performing the anodization process on the base material, a pretreatment, such as a degreasing process, a polishing process, or the like, may be performed on the base material as needed. For example, an alkali degreasing process in which an alkali cleaning liquid is used can be performed as the degreasing process. By performing the degreasing process, the gloss value of the aluminum member obtained after the anodization process can be decreased, and thereby an aluminum member with no luster can be obtained easily.

In addition, for example, a chemical-polishing process, a mechanical-polishing process, an electrolytic-polishing process, or the like can be performed as the polishing process. By performing the polishing process, the gloss value of the aluminum member obtained after the anodization process can be increased, and thereby an aluminum member having luster can be obtained easily. From the viewpoint of further increasing the gloss value of the aluminum member, it is preferable to perform the electrolytic-polishing process on the base material.

A liquid that contains boron atoms and has a pH of 7.0 or more and 12.0 or less can be used as the electrolytic solution used in the anodization process. For example, an aqueous solution of one or two or more electrolytes selected from the group consisting of boric acid and borate can be used as the electrolytic solution. Specifically, a salt of boric acid and ammonia, such as ammonium tetraborate and ammonium pentaborate, a salt of boric acid and an alkali metal element, such as sodium tetraborate, and the like can be given as examples of the electrolyte used in the electrolytic solution.

From the viewpoint of more easily forming the anodic oxide film having the above-mentioned specific structure, the electrolytic solution preferably is an aqueous solution of an electrolyte that contains ammonium tetraborate.

The concentration of the electrolytic solution can be set as appropriate in the range of, for example, 0.1 mol/L or more and 1.0 mol/L or less. The concentration of the electrolytic solution in the anodization process preferably is 0.2 mol/L or more and 0.9 mol/L or less. In this situation, the growth of the anodic oxide film during the anodization process can be further promoted. As a result, the thickness of the anodic oxide film can be easily increased.

The temperature of the electrolytic solution in the anodization process can be set as appropriate in the range of, for example, 283 K or higher and 343 K or lower. The temperature of the electrolytic solution in the anodization process preferably is 303 K or higher and 343 K or lower. In this situation, the concentration of the electrolytic solution can be increased suitably, and thereby the growth of the anodic oxide film during the anodization process can be further promoted. As a result, the thickness of the anodic oxide film can be easily increased.

In the anodization process, it is preferable to perform constant-current electrolysis at an electric current density of 10 $A/m^2$ or more and 200 $A/m^2$ or less. By performing the anodization process using this electric current condition, the growth of the anodic oxide film during the anodization process can be further promoted, and the anodic oxide film can be caused to grow more uniformly.

The process time of the anodization process can be set to, for example, 5 min or more. By setting the process time of the anodization process to 5 min or more, the anodic oxide film, in which the crystal layer is layered on the amorphous layer, can be formed more easily. In addition, the longer the process time of the anodization process, the more the thickness of the crystal layer can be increased, and thereby the wear-resistance characteristics of the aluminum member can be further improved. From such a viewpoint, the process time of the anodization process preferably is 10 min or more, more preferably is 20 min or more, and yet more preferably is 30 min or more.

Working Examples

Working examples of the above-mentioned aluminum member and the manufacturing method thereof will now be explained, with reference to FIG. 1 to FIG. 5. An aluminum member 1 of the present example comprises a base material 2, which is composed of aluminum or an aluminum alloy, and an anodic oxide film 3, which is formed on a surface of the base material 2, as shown in FIG. 1. The anodic oxide film 3 comprises: an amorphous layer 31, which is composed of an amorphous aluminum oxide and is formed on the base material 2; and a crystal layer 32, which is composed of a crystalline aluminum oxide and is formed on the amorphous layer 31.

It was possible to manufacture the aluminum member 1 of the present example by the following method. First, the base material 2, which was composed of high-purity aluminum having an Al purity of 99.99 mass %, was prepared. The base material 2 was a sheet material that exhibited a square shape in which one side was 20 mm. The degreasing process was performed by performing ultrasonic cleaning on the surface of the base material 2 using ethanol; subsequently, electrolytic polishing was performed.

By performing the anodization process, it was possible to form the anodic oxide film 3 on a surface of the base material 2 in an electrolytic solution containing boron atoms and having a pH of 7.0 or more and 12.0 or less, on the one side of the base material 2 that was subjected to pretreatment in this manner.

For example, it was possible to use the electrolytic solutions and process conditions listed in Table 1 in the anodization process. A more detailed configuration of the aluminum member 1 is explained below, using Test Material A to Test Material K listed in Table 1 as examples. It is noted that Test Material L to Test Material N listed in Table 1 were test materials for comparison with Test Material A to Test Material K. It was possible to manufacture Test Material L to Test Material N by the same method as that of Test Material A to Test Material K, except that the electrolytic solutions and process conditions were modified as listed in Table 1.

Structure of Anodic Oxide Film

By performing the cross-sectional observation, in which a field-emission, scanning-electron microscope (FE-SEM) was used, and the identification of the constituent substances, in which an X-ray diffraction apparatus was used, in combination, it was possible to evaluate the structure of the anodic oxide film.

When performing the cross-sectional observation, first, for each test material of Test Material A to Test Material N, the anodic oxide film was caused to fracture by subjecting it to V bending such that the surface that underwent the anodization process became the outer side. By observing a fractured surface of the anodic oxide film using FE-SEM, it was possible to evaluate the layered structure of the anodic oxide film. The results of the cross-sectional observations were recorded as "Single Layer" in the "Layered Structure" column in Table 2 in the situation in which the anodic oxide film was composed of a single layer, and were recorded as "Two Layers" in the same column in the situation in which the anodic oxide film was a two-layer structure. In addition, in the situation in which an anodic oxide film was not formed, "—" was recorded in the same column.

In addition, when performing the identification of the constituent substances, X-ray diffraction charts were acquired by radiating X-rays onto each anodic oxide film of Test Material A to Test Material N using an X-ray diffraction apparatus ("RINT-2500" made by Rigaku Corporation). Furthermore, by comparing the diffraction peaks appearing in the X-ray diffraction chart with diffraction patterns of well-known substances, it was possible to identify the substances corresponding to the diffraction peaks appearing in the X-ray diffraction chart. In addition, in the situation in which a broad peak having a vertex at a diffraction angle in the range of 20°-40° appeared in the X-ray diffraction chart, it was possible to determine that the anodic oxide film contained an amorphous substance.

The column "Constituent Substances" in Table 2 lists the substances contained in Test Material A to Test Material N.

As shown in Table 2, every anodic oxide film 3 of Test Material A to Test Material K had a two-layer structure. In greater detail, every anodic oxide film 3 of Test Material A to Test Material K had: an amorphous layer, which was formed on the base material 2 and had a relatively uniform thickness and no defects; and a crystal layer, which was formed on that amorphous layer and on or in which small holes 321, discharge marks, dissolution marks, or the like were present; Test Material B is shown as one example in FIG. 2. As can be seen in FIG. 1, the small holes 321 extend completely through the crystal layer 32 to the amorphous layer 31.

Figure 3:
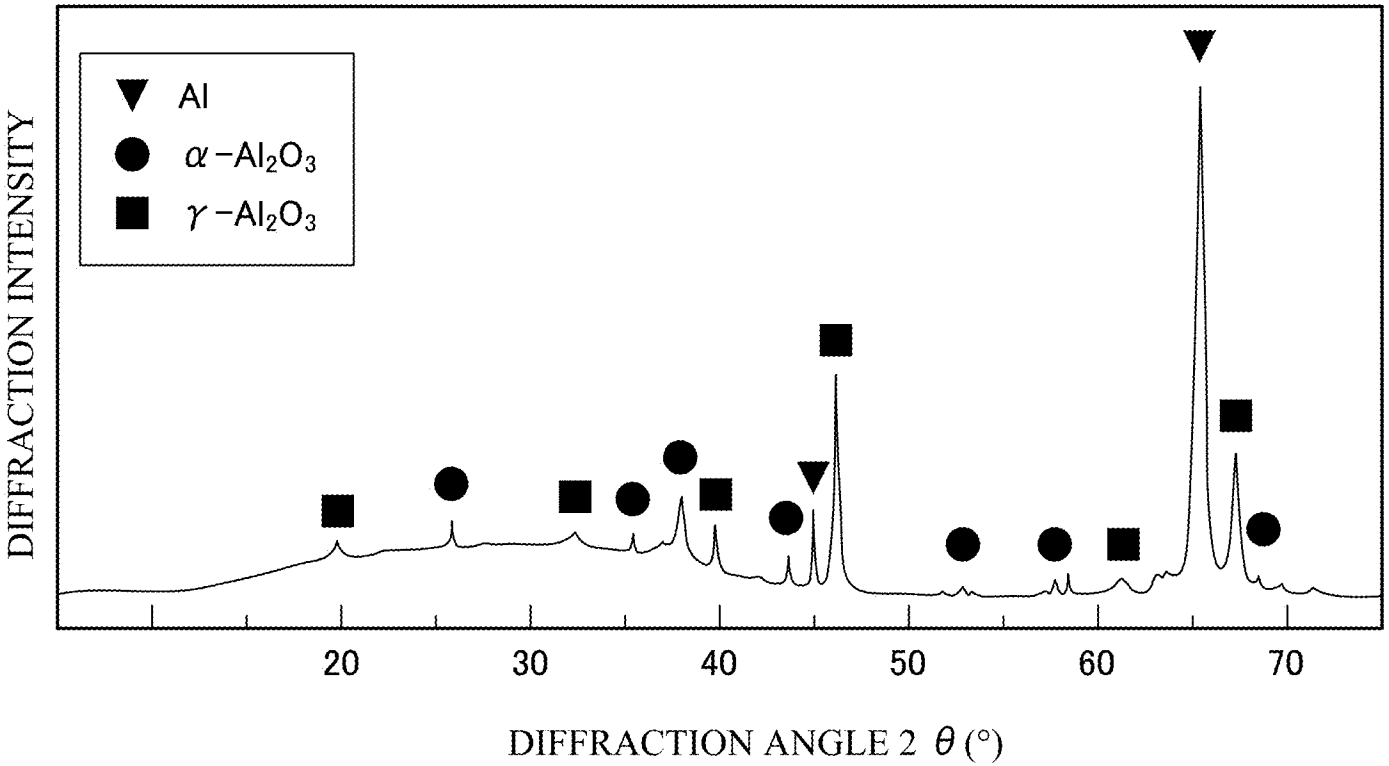
FIG. 3 is an X-ray diffraction chart of Test Material B according to the working example.
Figure 4:
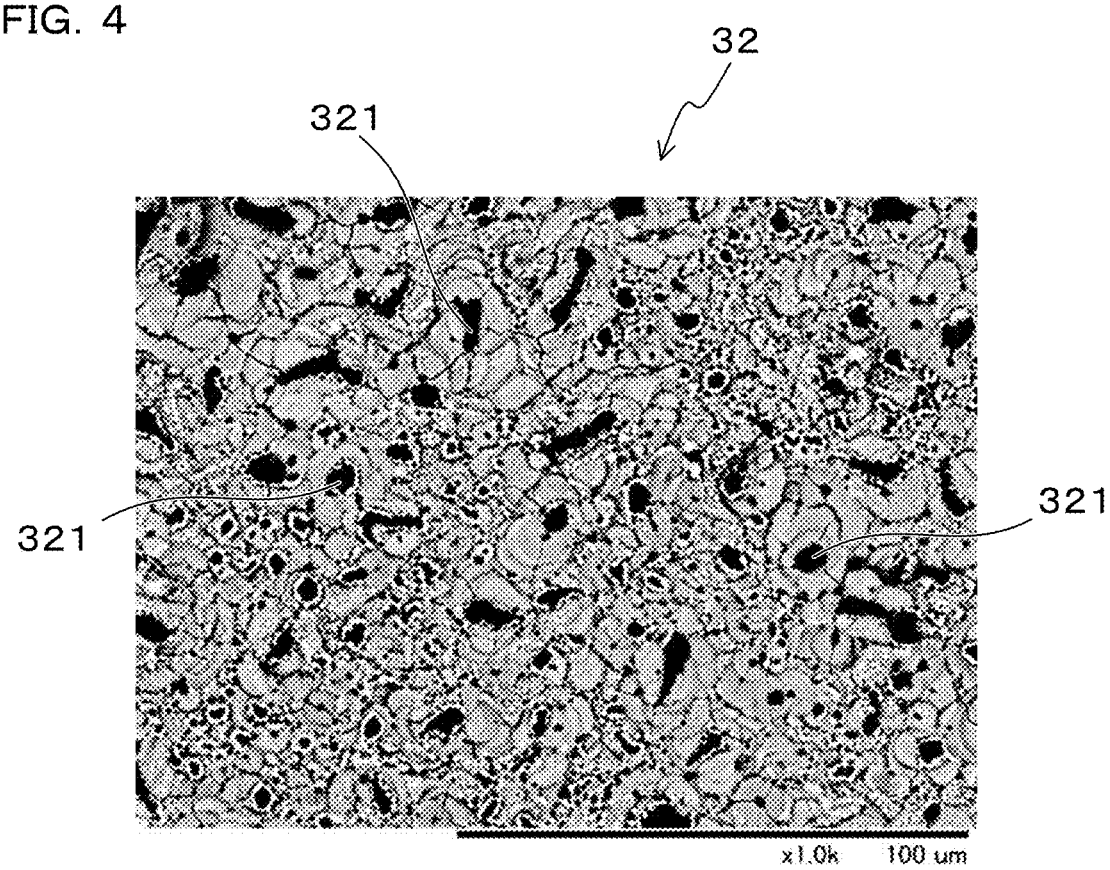
FIG. 4 is an electron micrograph of the surface of the anodic oxide film of Test Material B according to the working example.
Figure 5:
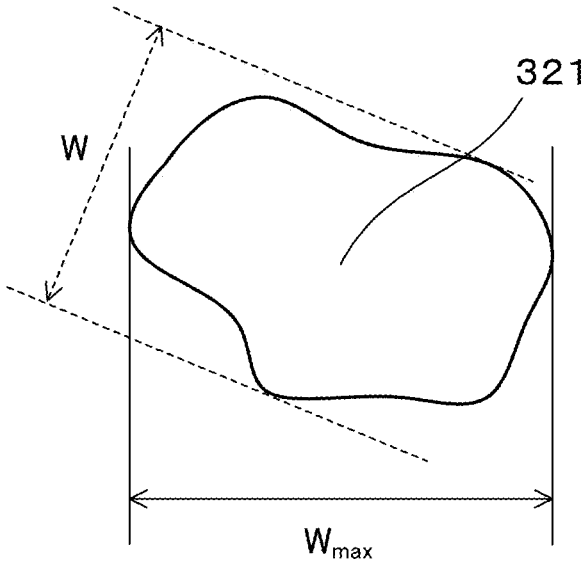
FIG. 5 is an explanatory diagram of a method of measuring the maximum width of a small hole.

In addition, FIG. 3 shows an X-ray diffraction chart of Test Material B as one example. It is noted that the ordinate in FIG. 3 is Diffraction Intensity and the abscissa is Diffraction Angle 2θ (°). Although not shown in the drawings, the X-ray diffraction charts for Test Material A and Test Material C to Test Material K were the same as for Test Material B. As shown in Table 2, according to these results, it could be understood that each anodic oxide film 3 of Test Material A to Test Material K was composed of $\alpha$-$Al_2O_3$ and $\gamma$-$Al_2O_3$, which are crystalline aluminum oxides, and amorphous aluminum oxides.

On the other hand, as shown in Table 2, a single layer of anodic oxide film composed of amorphous aluminum oxides was formed on Test Material L, for which the process time in the anodization process was shorter than for Test Material A to Test Material K. By comparing Test Material A to Test Material K with Test Material L, it could be understood that the layer formed on each base material 2 for Test Material A to Test Material K was the amorphous layer 31 composed of amorphous aluminum oxides, and that the crystal layer 32 was formed on the amorphous layer 31.

Because the electrolytic solution for Test Material M was an aqueous solution of sodium hydroxide, the dissolution rate of the anodic oxide film and the base material was faster than the growth rate of the anodic oxide film during the anodization process. Consequently, it was difficult to form an anodic oxide film on the surface of Test Material M.

Because the electrolytic solution for Test Material N was aqueous sulfuric acid, dielectric breakdown did not occur while the anodization process progressed. Consequently, a single layer of anodic oxide film composed of amorphous aluminum oxides and having small holes was formed on the surface of Test Material N.

Surface Structure of Crystal Layer

By observing the surfaces of Test Material A to Test Material K using FE-SEM, it was possible to evaluate the surface structure of each crystal layer 32. Numerous small holes 321 were present on the surface of each crystal layer 32, as shown by the electron micrograph of the surface of Test Material B as one example in FIG. 4.

The average diameter of the small holes 321 present on each crystal layer 32 was calculated as follows. First, 10 small holes 321 to be measured were randomly selected from the small holes 321 present in the electron micrograph. Next, as shown by the example in FIG. 5, width W of each small hole 321 to be measured was measured from various directions. Furthermore, the maximum value of width W of each small hole 321 measured from various directions was set as maximum width $W_{max}$ of that small hole. The arithmetic-average value of maximum widths $W_{max}$ of the 10 small holes 321 obtained in this manner was set as the average diameter of the small holes 321.

The average diameter of the small holes 321 for each test material of Test Material A to Test Material K is the value listed in Table 2. It is noted that, because small holes were not present in Test Material L and Test Material M, which did not have the crystal layer 32, the symbol "—" was recorded in the "Average Diameter of Small Holes" column in Table 2. It was possible to calculate the average diameter of the small holes for Test Material N by the same method as for Test Material A to Test Material K. The average diameter of the small holes for Test Material N is the value listed in Table 2.

As shown in Table 2, the average small-hole diameters for Test Material A to Test Material K were 1 μm or more and 20 μm or less.

Evaluation of Arithmetic-Average Roughness Ra

It was possible to evaluate arithmetic-average roughness Ra of the surface of each anodic oxide film using a method compliant with JIS B0601:2013. Specifically, first, the anodic oxide film was observed at a magnification of 50 times using a laser microscope ("OLS-3000" made by Olympus Corporation), and a three-dimensional image including height information of the surface of the anodic oxide film was acquired. Arithmetic-average roughness Ra was calculated at three randomly selected locations in the three-dimensional image obtained in this manner. Furthermore, the arithmetic-average value of arithmetic-average roughnesses Ra at these three locations was set as arithmetic-average roughness Ra of the surface of the anodic oxide film. Arithmetic-average roughness Ra of the surface for each anodic oxide film of Test Material A to Test Material K and Test Material N is the value listed in Table 2. It is noted that, because Test Material L and Test Material M did not have the crystal layer 32, the measurement of arithmetic-average roughness Ra was unnecessary. For this reason, the symbol "—" was recorded in the "Arithmetic-Average Roughness Ra" column for these test materials.

Next, the method of evaluating the characteristics of the aluminum member 1 will be explained.

Appearance Characteristics

It was possible to evaluate the appearance characteristics of the aluminum member 1 based on the uniformity of the external appearance of the anodic oxide film 3 by visual observation and by SEM observation. The meanings of the symbols recorded in the "Appearance Characteristics" column in Table 2 are as below.

A: In both visual observation and SEM observation, the external appearance of the anodic oxide film was uniform.

B: The external appearance of the anodic oxide film was uniform for visual observation but, in SEM observation, portions in which a discharge mark was formed and portions in which a discharge mark was not formed were mixed.

C: The external appearance of the anodic oxide film was uneven for visual observation but, in SEM observation, portions in which a discharge mark was formed were present.

D: The external appearance of the anodic oxide film was uneven for visual observation but, in SEM observation, portions in which a discharge mark was formed were not present.

Design Characteristics

It was possible to evaluate the design characteristics of the aluminum member 1 based on the color tone of the surface of the anodic oxide film 3. The "Design Characteristics" column in Table 2 indicates the L* values of the CIE 1976 (International Commission on Illumination) L*a*b* color space for Test Material A to Test Material K and Test Material N. It is noted that it was possible to use a spectral colorimeter (e.g., the colorimeter "CC-iS" made by Suga Test Instruments Co., Ltd.) compliant with JIS Z8781-4: 2013 in the measurement of the L* value. It is noted that, because Test Material L did not have a crystal layer, the symbol "—" was recorded in the "Design Characteristics" column. In addition, because the Test Material M did not have an anodic oxide film, the symbol "—" was recorded in the "Design Characteristics" column.

TABLE 1

| Test | Electrolytic Solution | | | Process Conditions | | |
|---|---|---|---|---|---|---|
| Material Symbol | Electrolyte | Concentration (mol/L) | pH | Temperature of Electrolytic Solution (K) | Current Density ($A/m^2$) | Process Time (min) |
| A | Ammonium pentaborate | 0.1 | 7.5 | 333 | 40 | 60 |
| B | Ammonium tetraborate | 0.3 | 8.5 | 323 | 100 | 60 |
| C | Ammonium tetraborate | 0.6 | 9.1 | 323 | 100 | 60 |
| D | Ammonium tetraborate | 0.9 | 10 | 323 | 100 | 60 |
| E | Ammonium tetraborate | 0.3 | 8.9 | 283 | 100 | 60 |
| F | Ammonium tetraborate | 0.3 | 8.7 | 303 | 100 | 60 |
| G | Ammonium tetraborate | 0.3 | 8.2 | 343 | 100 | 60 |
| H | Ammonium tetraborate | 0.9 | 10 | 323 | 10 | 60 |
| I | Ammonium tetraborate | 0.9 | 10 | 323 | 25 | 60 |
| J | Ammonium tetraborate | 0.9 | 10 | 323 | 50 | 60 |
| K | Ammonium tetraborate | 0.9 | 10 | 323 | 200 | 60 |
| L | Ammonium tetraborate | 0.3 | 8.5 | 323 | 100 | 1 |
| M | Sodium hydroxide | 0.1 | 13 | 323 | 10 | 60 |
| N | Sulfuric acid | 1.0 | −0.3 | 293 | 10 | 30 |

TABLE 2

| Test | | Constituent Substances | | | | Average Diameter of | Arithmetic-Average | | |
|---|---|---|---|---|---|---|---|---|---|
| Material Symbol | Layered Structure | Al | $\alpha$-$Al_2O_3$ | $\gamma$-$Al_2O_3$ | Amorphous Substance | Small Holes (μm) | Roughness Ra (μm) | Appearance Characteristics | Design Characteristics |
| A | Two Layers | Yes | Yes | Yes | Yes | 1 | 0.36 | B | 74.6 |
| B | Two Layers | Yes | Yes | Yes | Yes | 20 | 1.08 | A | 78.9 |
| C | Two Layers | Yes | Yes | Yes | Yes | 10 | 0.83 | A | 82.4 |
| D | Two Layers | Yes | Yes | Yes | Yes | 5 | 0.96 | A | 84.4 |
| E | Two Layers | Yes | Yes | Yes | Yes | 20 | 0.85 | B | 72.2 |
| F | Two Layers | Yes | Yes | Yes | Yes | 20 | 1.17 | A | 72.9 |
| G | Two Layers | Yes | Yes | Yes | Yes | 8 | 0.67 | A | 78.8 |
| H | Two Layers | Yes | Yes | Yes | Yes | 4 | 0.31 | C | 73.2 |
| I | Two Layers | Yes | Yes | Yes | Yes | 3 | 0.60 | B | 79.0 |
| J | Two Layers | Yes | Yes | Yes | Yes | 5 | 0.68 | A | 79.7 |
| K | Two Layers | Yes | Yes | Yes | Yes | 8 | 0.79 | C | 82.4 |
| L | Single Layer | Yes | No | No | Yes | — | — | D | — |
| M | — | Yes | No | No | No | — | — | D | — |
| N | Single Layer | Yes | No | No | Yes | 0.01 | 0.11 | D | 68.4 |

As shown in Table 1, the anodic oxide film 3 of Test Material A to Test Material K had a two-layer structure, in which the crystal layer 32 was layered on the amorphous layer 31. Consequently, as shown in Table 2, these test materials can be expected to have both excellent insulation characteristics and corrosion-resistance characteristics, deriving from the amorphous layer 31, and excellent wear-resistance characteristics, deriving from the crystal layer 32.

In addition, the average diameter of the small holes 321 present in the crystal layer 32 for Test Material A to Test Material K and the arithmetic-average roughness Ra for Test Material A to Test Material K were within the above-mentioned specific ranges, respectively. Consequently, the external appearance of Test Material A to Test Material K was opaque white and had excellent design characteristics.

Because the process time of the anodization process for Test Material L was shorter than for Test Material A to Test Material K, dielectric breakdown of the surface of the amorphous layer 31 did not occur during the anodization process. Consequently, it was difficult to form a crystal layer on the amorphous layer 31 for Test Material L.

Because the electrolytic solution for Test Material M was an aqueous solution of sodium hydroxide, the dissolution rate of the anodic oxide film and the base material was faster than the growth rate of the anodic oxide film during the anodization process. Consequently, it was difficult to form an anodic oxide film on the surface of Test Material M. Accordingly, it was surmised that Test Material M is inferior in its insulation characteristics, corrosion-resistance characteristics, and wear-resistance characteristics compared with Test Material A to Test Material K.

Because the electrolytic solution for Test Material N was aqueous sulfuric acid, dielectric breakdown did not occur during the anodization process. Consequently, it was difficult to form a crystal layer on the surface of Test Material N. Accordingly, it was surmised that Test Material N is inferior in its wear-resistance characteristics compared with Test Material A to Test Material K. In addition, because the transparency of the anodic oxide film formed on the surface of Test Material N was high, the external appearance of Test Material N tended to become a color tone that is close to the color tone of the base material.

As described above, specific aspects of the above-mentioned aluminum member and the manufacturing method thereof were explained based on the working examples, but the aspects of the aluminum member and the manufacturing method thereof according to the present invention are not limited to the aspects of the working examples described above, and the configuration can be modified where appropriate within a range that does not depart from the gist of the present invention.

The invention claimed is:

1. A method of manufacturing an aluminum member, wherein:

the aluminum member has an anodic oxide film formed on a surface of a base material composed of aluminum or an aluminum alloy, the anodic oxide film comprising: an amorphous layer, which is composed of an amorphous aluminum oxide and is formed on the base material; and a crystal layer, which is composed of a crystalline aluminum oxide and is formed on the amorphous layer; and the method comprises:

forming the amorphous layer by performing an anodization process on the base material, and then forming the crystal layer on top of the amorphous layer by continuing the anodization process, wherein:

the amorphous layer and the crystal layer are formed in an electrolytic solution that contains boron atoms and has a pH of 7.5 or more and 12.0 or less, the crystal layer is exposed on an outermost surface of the anodic oxide film, and after performing the anodization process, the crystal layer has small holes having an average diameter of 1 μm or more and 20 μm or less.

2. A method of manufacturing an aluminum member, wherein:

the aluminum member has an anodic oxide film formed on a surface of a base material composed of aluminum or an aluminum alloy, the anodic oxide film comprising: an amorphous oxide layer, which is composed of an amorphous aluminum oxide and is formed on the base material; and a crystal oxide layer, which is composed of a crystalline aluminum oxide and is formed on the amorphous oxide layer; and the method comprises:

forming the amorphous oxide layer by performing an anodization process on the base material by applying a constant current at an electric-current density of 10 $A/m^2$ or more and 200 $A/m^2$ or less, and then forming the crystal oxide layer on top of the amorphous oxide layer by continuing to apply the constant current in the anodization process such that micro arcs occur discontinuously on an outermost surface of the amorphous oxide layer, thereby repetitively melting and solidifying the outermost surface of the amorphous oxide layer to form the crystal oxide layer on the outermost surface of the amorphous oxide layer, wherein:

the amorphous oxide layer and the crystal oxide layer are formed in an electrolytic solution that contains boron atoms, has an electrolyte concentration of 0.1-1.0 mol/L, is at a temperature of 283K or higher and 343K or lower and has a pH of 7.5 or more and 12.0 or less, the anodization process is performed for 5 minutes or more, and the crystal oxide layer is exposed on an outermost surface of the anodic oxide film.

3. The method according to claim 2, wherein, after performing the anodization process, an arithmetic-average roughness Ra of the surface of the anodic oxide film is 0.5 μm or more and 1.5 μm or less.

4. The method according to claim 2, wherein, after performing the anodization process, an L* value of a CIE 1976 L*a*b* color space obtained by measuring color tone of the surface of the aluminum member having the anodic oxide film is 70.0 or more.

5. The method of manufacturing the aluminum member according to claim 2, wherein the electrolytic solution is an aqueous solution of ammonium tetraborate.

6. The method of manufacturing the aluminum member according to claim 2, further comprising:

prior to the step of forming the anodic oxide film, degreasing and/or polishing the base material, and thereafter, initiating and performing the anodization process.

7. The method of manufacturing the aluminum member according to claim 2, wherein the base material is composed of aluminum having an Al purity of at least 99.99 mass %.

8. The method according to claim 2, wherein, after performing the anodization process, the outermost surface of the amorphous oxide layer has an arithmetic-average roughness Ra of 0.5-1.5 μm.

9. The method according to claim 8, wherein, after performing the anodization process, the surface of the anodic oxide film has an L* value of a CIE 1976 L*a*b* color space of 70.0 or more.

10. The method according to claim 9, wherein the anodization process is concluded when the amorphous oxide layer has a thickness of 0.10-0.90 μm.

11. The method according to claim 9, wherein the anodization process is concluded when the amorphous oxide layer has a thickness of 0.20-0.80 μm.

12. The method according to claim 11, wherein, after performing the anodization process, the crystal oxide layer is composed of $\alpha$-$Al_2O_3$ and/or $\gamma$-$Al_2O_3$.

13. The method according to claim 12, wherein the anodization process is concluded when the crystal oxide layer has a thickness of 1.0-15.0 μm.

14. The method according to claim 2, wherein the anodization process is concluded when the amorphous oxide layer has a thickness of 0.10-0.90 μm.

15. The method according to claim 2, wherein the anodization process is concluded when the amorphous oxide layer has a thickness of 0.20-0.80 μm.

16. The method of manufacturing the aluminum member according to claim 2, wherein, upon conclusion of the anodization process, the crystal oxide layer covers substantially all of the outermost surface of the amorphous oxide layer.

17. The method of manufacturing the aluminum member according to claim 2, wherein the anodization process is performed at least until the crystal oxide layer has a minimum thickness of 1.0 μm or more.

18. The method of manufacturing the aluminum member according to claim 2, wherein the electrolytic solution contains at least 0.1 mol/L of ammonium tetraborate or ammonium pentaborate.

19. The method of manufacturing the aluminum member according to claim 2, wherein:

while forming both the amorphous oxide layer and the crystal oxide layer, the constant-current electrolysis is performed at a temperature of the electrolytic solution of 303K or higher and 343K or lower and the electric-current density is 50 $A/m^2$ or more and 200 $A/m^2$ or less, the electrolytic solution is an aqueous solution of ammonium tetraborate having an electrolyte concentration of 0.2-0.9 mol/L, and the anodization process is performed for 30 min or more.

20. The method of manufacturing the aluminum member according to claim 19, wherein the anodization process is performed until:

the thickness of the amorphous oxide layer is 0.2 μm or more and 0.8 μm or less, the thickness of the crystal oxide layer 3.0 μm or more, and small holes having an average diameter of 1-20 μm extend entirely through the crystal oxide layer to the amorphous oxide layer.

21. A method of forming an anodic oxide film on an aluminum member, comprising:

immersing the aluminum member in an electrolytic solution that contains boron atoms and has a pH of 7.5 or more and 12.0 or less; and performing electrolysis by applying a current to the electrolytic solution and the aluminum member, wherein an amorphous oxide layer first forms on a surface of the aluminum member and then, with continued application of the current in the same electrolytic solution, micro arcs occur discontinuously on an outer surface of the amorphous oxide layer, thereby repetitively melting and solidifying the surface of the amorphous layer to form a crystal oxide layer on the outer surface of the amorphous oxide layer, wherein, after performing the electrolysis, the crystal layer is exposed on an outermost surface of the anodic oxide film.

22. The method according to claim 21, wherein:

the surface of the aluminum member is polished prior to immersing in the electrolytic solution and the amorphous oxide layer forms on the polished surface of the aluminum member; and the electrolytic solution is held at a temperature of 283-343 K throughout the electrolysis forming the amorphous oxide layer and the crystal oxide layer.

23. The method of manufacturing the aluminum member according to claim 21, wherein:

while forming both the amorphous oxide layer and the crystal oxide layer, constant-current electrolysis is performed at a temperature of the electrolytic solution of 283K or higher and 343K or lower and an electric-current density of 10 $A/m^2$ or more and 200 $A/m^2$ or less, and the electrolytic solution has an electrolyte concentration of 0.1-1.0 mol/L.

* * * * *